US011807999B2

(12) United States Patent
Mereu

(10) Patent No.: US 11,807,999 B2
(45) Date of Patent: Nov. 7, 2023

(54) PANIC BARRIER FOR MODULAR FENCES

(71) Applicant: Good Job S.R.L., Florence (IT)

(72) Inventor: Francesco Mereu, Prato (IT)

(73) Assignee: Good Job S.R.L., Florence (IT)

( * ) Notice: Subject to any disclaimer, the term of this patent is extended or adjusted under 35 U.S.C. 154(b) by 358 days.

(21) Appl. No.: 16/972,040

(22) PCT Filed: Jun. 7, 2019

(86) PCT No.: PCT/IT2019/050128
§ 371 (c)(1),
(2) Date: Dec. 4, 2020

(87) PCT Pub. No.: WO2019/234780
PCT Pub. Date: Dec. 12, 2019

(65) Prior Publication Data
US 2021/0238817 A1 Aug. 5, 2021

(30) Foreign Application Priority Data
Jun. 8, 2018 (IT) ..... 102018000006151

(51) Int. Cl.
*E01F 13/02* (2006.01)
*E04H 17/18* (2006.01)

(52) U.S. Cl.
CPC ..... *E01F 13/022* (2013.01); *E04H 17/185* (2021.01)

(58) Field of Classification Search
CPC ..... E04H 17/18; E04H 17/185; E04H 17/14; E04H 17/16; E01F 13/02; E01F 13/022; E01F 9/688
See application file for complete search history.

(56) References Cited

U.S. PATENT DOCUMENTS 5,220,740 A * 6/1993 Brault ..... F16M 11/42 40/607.1
5,722,788 A * 3/1998 Bent ..... E01F 9/688 116/63 P
7,918,622 B2 * 4/2011 Whitford ..... F41H 11/08 404/6

(Continued)

FOREIGN PATENT DOCUMENTS

DE 202016100217 U1 10/2016
FR 2384900 A1 * 10/1978

(Continued)

OTHER PUBLICATIONS

International Search Report, PCT/IT2019/050128, dated Jul. 31, 2019.

(Continued)

*Primary Examiner* — Jonathan P Masinick
(74) *Attorney, Agent, or Firm* — Nancy J. Flint, Attorney At Law, P.A.; Nancy J. Flint, Esq.

(57) ABSTRACT

A panic barrier for containing pedestrians on the occasion of big events. Said barrier is such as not to overturn whenever the crowd presses against the parapet, thanks to the presence of a fulcrum element integral with the lower portion of the parapet on the side opposite to that of the footboard on which pedestrians walk. Advantageously numerous variants of modular fences can be created by combining a plurality of panic barriers with each other.

11 Claims, 12 Drawing Sheets

(56) References Cited

U.S. PATENT DOCUMENTS

| | | | | |
|---|---|---|---|---|
| 8,215,866 | B2 * | 7/2012 | Whitford | F41H 5/14 404/9 |
| 9,822,549 | B2 * | 11/2017 | Gentry | E04H 17/18 |
| 10,415,198 | B1 * | 9/2019 | Thomas | E01F 13/12 |
| 11,365,955 | B2 * | 6/2022 | Downing | F41H 11/08 |
| 11,447,973 | B2 * | 9/2022 | Samara | F41H 11/10 |
| 2017/0009485 | A1 | 1/2017 | Gentry | |
| 2022/0298733 | A1 * | 9/2022 | Graziadei | E01F 13/12 |

FOREIGN PATENT DOCUMENTS

| | | | |
|---|---|---|---|
| GB | 1264309 | A | 2/1972 |
| GB | 2271584 | A | 4/1994 |
| WO | 201268593 | A2 | 5/2012 |

OTHER PUBLICATIONS

Written Opinion of the International Searching Authority, PCT/IT2019/050128, dated Jul. 31, 2019.

* cited by examiner

PANIC BARRIER FOR MODULAR FENCES

TECHNICAL FIELD

The present invention belongs to the sector of road barriers for temporarily delimiting spaces, in particular to the sector of modular fences for containing pedestrians. More specifically, this invention concerns a road barrier comprised of one or several movable barriers of an innovative type, used for temporarily delimiting areas, set roads and escape paths on the occasion of events that draw a large audience, such as recitals and open-air events, road races, and the like.

The movable barrier according to the present patent application features specific safety and roll-over characteristics, which make it particularly suitable for containing the crowd even in the case the latter presses against the containment barriers.

PRESENT STATUS OF THE ART

Different types of movable barriers are known or are used aiming at closing the traffic of pedestrians; in almost all cases, they are barriers that rest on the ground by way of feet or a base and, thanks to the friction developing between the ground and the base of the barrier, it is difficult to displace them by exerting a horizontal thrust thereon. Friction is proportional to the weight of the barrier and to a coefficient which depends both on the paving type and on the characteristics of the base of the barrier.

An important drawback of this type of barriers consists in that, if the horizontal thrust exerted by the crowd exceeds the resistance offered by friction, the barrier begins scraping against the ground and displacing and, if it finds an obstacle in its path, it easily overturns, just because of the horizontal thrust which develops an overturning moment whose extent exceeds that of the stabilizing moment developed by the weight of the barrier itself about the center of rotation.

Therefore, when using traditional barriers, it is necessary to increase the weight of the object in order to get stability; however, an increased weight means increasing costs, greatly reducing the capability of easily handling the barrier, and making its transportation and storage difficult because a means of transport, such as for example a lift truck, is often necessary.

In particular, heavy barriers, such as for instance the "new jersey" ones, cannot be displaced quickly, which results in a major drawback in the case of accidents whereby it is necessary to quickly modify the arrangement of the barriers, for instance whenever it is necessary to create a passage and allow for the transit of rescue vehicles.

GB 2271 584 (A) discloses a pedestrian barrier equipped with a vertical parapet, with each side of which a person supporting footboard and a platform for the rescue personnel are associated respectively, the latter being at a higher level than the table. The footboard is a rectangular platform, whose short sides are orthogonal to the vertical parapet; the footboard is inclined and rests on the ground, the long side being more far away from the vertical parapet.

WO 201268593 (A2) discloses a movable barrier wherein the parapet is not perfectly vertical, but is inclined on the side opposed to the crowd.

DE 202016100217 (U1) discloses a panic barrier which complements a footboard resting on the ground.

The barrier according to the present patent application, on the contrary, comprises a footboard shaped like an inclined platform, with limited areas where to rest on the ground, and consequently concentrates the loads on extremely limited portions of the ground, which fosters load concentration and enhances the effect of friction, thus rendering it more difficult to make the barrier scrape against the ground and displace it.

Elements made from a non-slip material, such as for instance rubber, can be interposed between the barrier and the ground in order to improve friction.

OBJECTS AND SUMMARY OF THE INVENTION

A first object of the present invention is thus to provide a movable barrier, suitable for implementing modular fences, particularly safe and such as not to easily displace and overturn whenever the crowd presses against it.

A second object of the invention is to provide a movable barrier that is lightweight and simultaneously is easy to position and little bulky to transport.

A further object of the invention is to implement a movable barrier that, in case of need, can be displaced manually, without any need for using means of transport.

A last but not least object of the present invention is to implement a barrier that is easily stackable as well as difficult to overturn and easy to displace on the ground. Advantageously the barrier according to the present patent application comprises a footboard, suitable for resting on the ground, and a parapet which raises off on an edge of said footboard. The footboard is comprised of an elongate table, which includes two edges parallel to the plane defined by the parapet which the innermost edge is integrally connected to.

In a preferred embodiment, the outermost edge rests on the ground whereas the innermost edge is slightly raised off the ground. This embodiment improves resistance to horizontal displacement as compared to a constructive solution wherein the footboard rests on the ground parallel to the latter.

At least one fulcrum element, which goes down to the ground, raises off on the footboard side opposed to the parapet.

A particularly functional version comprises a crossbar which runs below the inner edge of the footboard and rests on the ground, thus discharging a part of the weight to the ground, whereby the total weight is shared by this bar, the outer edge of the footboard, and the at least one fulcrum element.

In a particularly convenient and practical embodiment, the parapet is not vertical, but is rather slightly inclined on the side of the footboard.

At least one wheel is rotationally coupled with the projecting fulcrum, in order to make it easier to displace the barrier, the wheel being slightly raised off the ground whenever the barrier is in an operating position and only touches the ground after the barrier is inclined on the side opposed to the footboard; in this way, it is possible to displace the barrier easily.

The lower portion of the parapet defines at least one opening suitable for receiving the wheel of a second barrier stacked above the first one, in order to make it possible to stack several barriers one above the other. Advantageously the wheel not touching the ground when the barrier is in an operating position makes it possible to stack barriers without the wheel of an overhanging barrier getting in contact with the barrier underneath.

Figure 1:
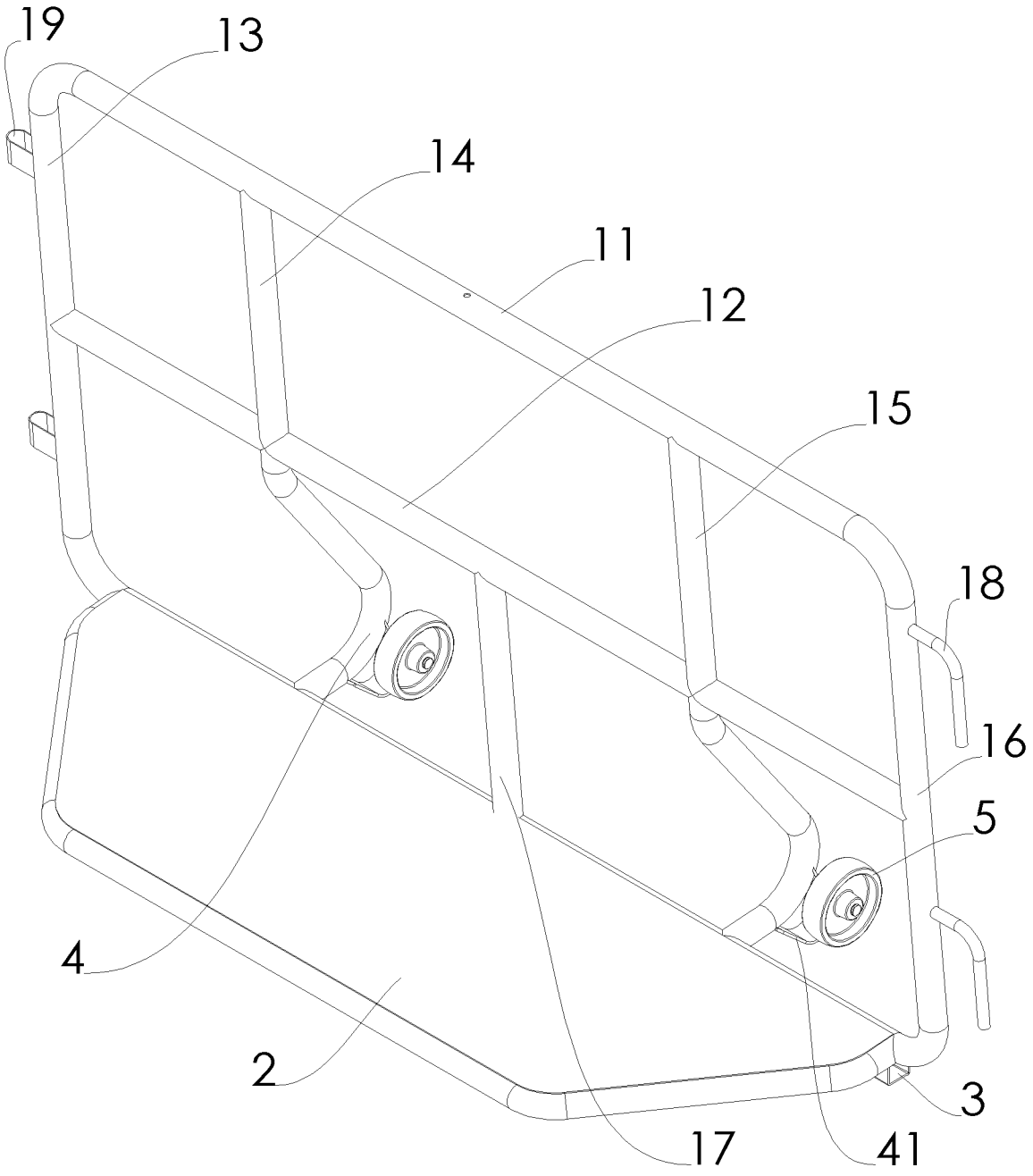
FIG. 1 shows an axonometric view of an embodiment of the barrier according to the present patent application, wherein the inclined footboard (2) is shown in the foreground; this figure also shows a parapet (1), the latter comprising an upper cross member (11) and an intermediate cross member (12), besides four uprights (13, 14, 15 and 16). The two side uprights (13, 16) are rectilinear, whereas the two intermediate uprights (14, 15) are only rectilinear in that upper portion which joins the intermediate cross member (12) to the upper cross member (11); in the lower portion, each of the two intermediate uprights defines a bend which projects from the plane of the parapet on the part opposed to the footboard (2); these bends make-up fulcrum elements (4) and each of them is complemented by a rounded foot (41) which touches the ground whenever the barrier is in an operating position; a horizontal axis wheel (5) is rotationally connected to every foot.

The inner edge (22) is also connected to the intermediate cross member (12) by way of a half-upright (17). The figure also shows male connection means (18) and female connection means (19) integrally connected to the side uprights (13, 16).

Figure 2:
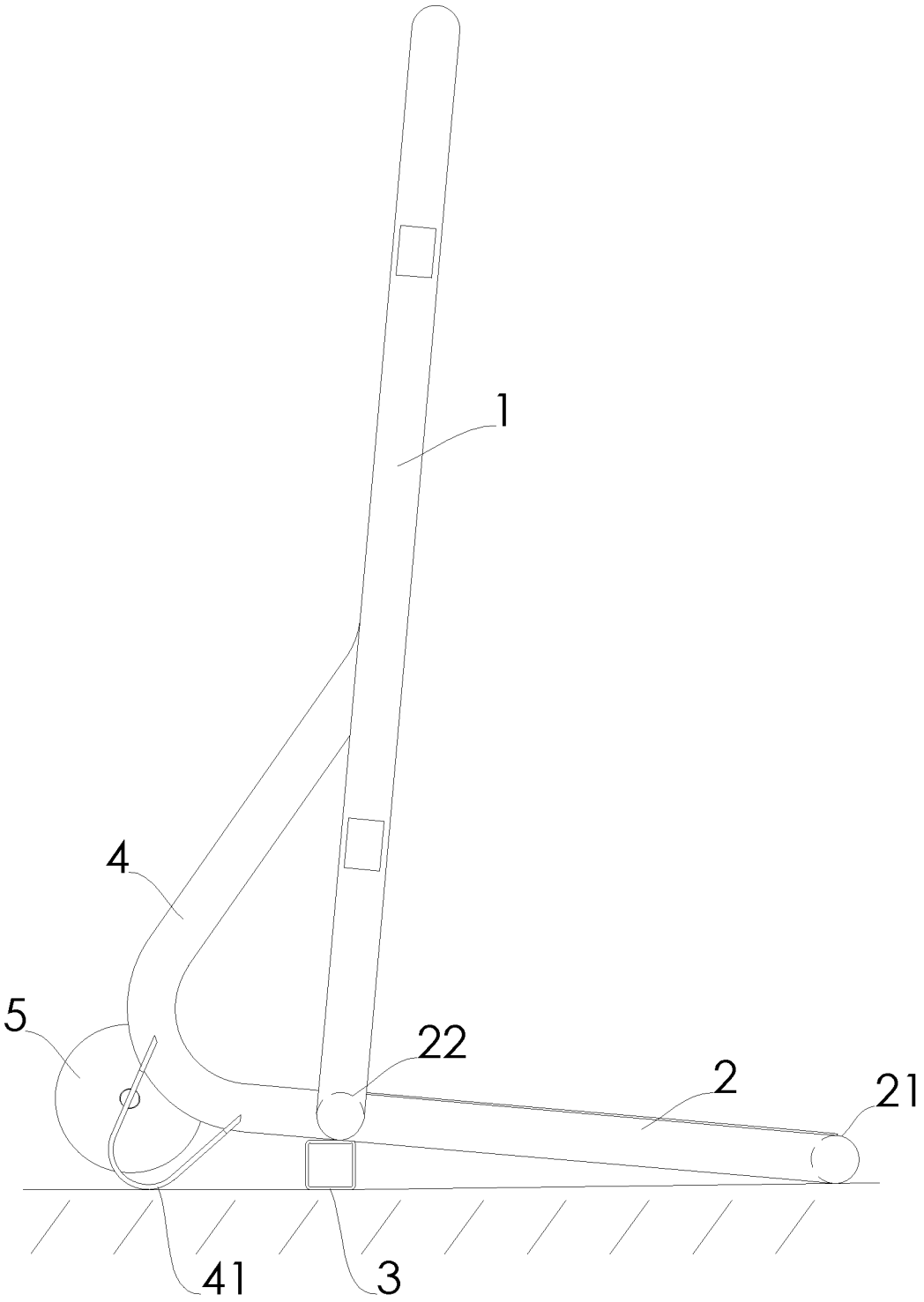

FIG. 2 shows a side view of a barrier in an operating position, in particular it shows a rounded foot (41), a wheel (5), and the cross member (3).

Figure 3:
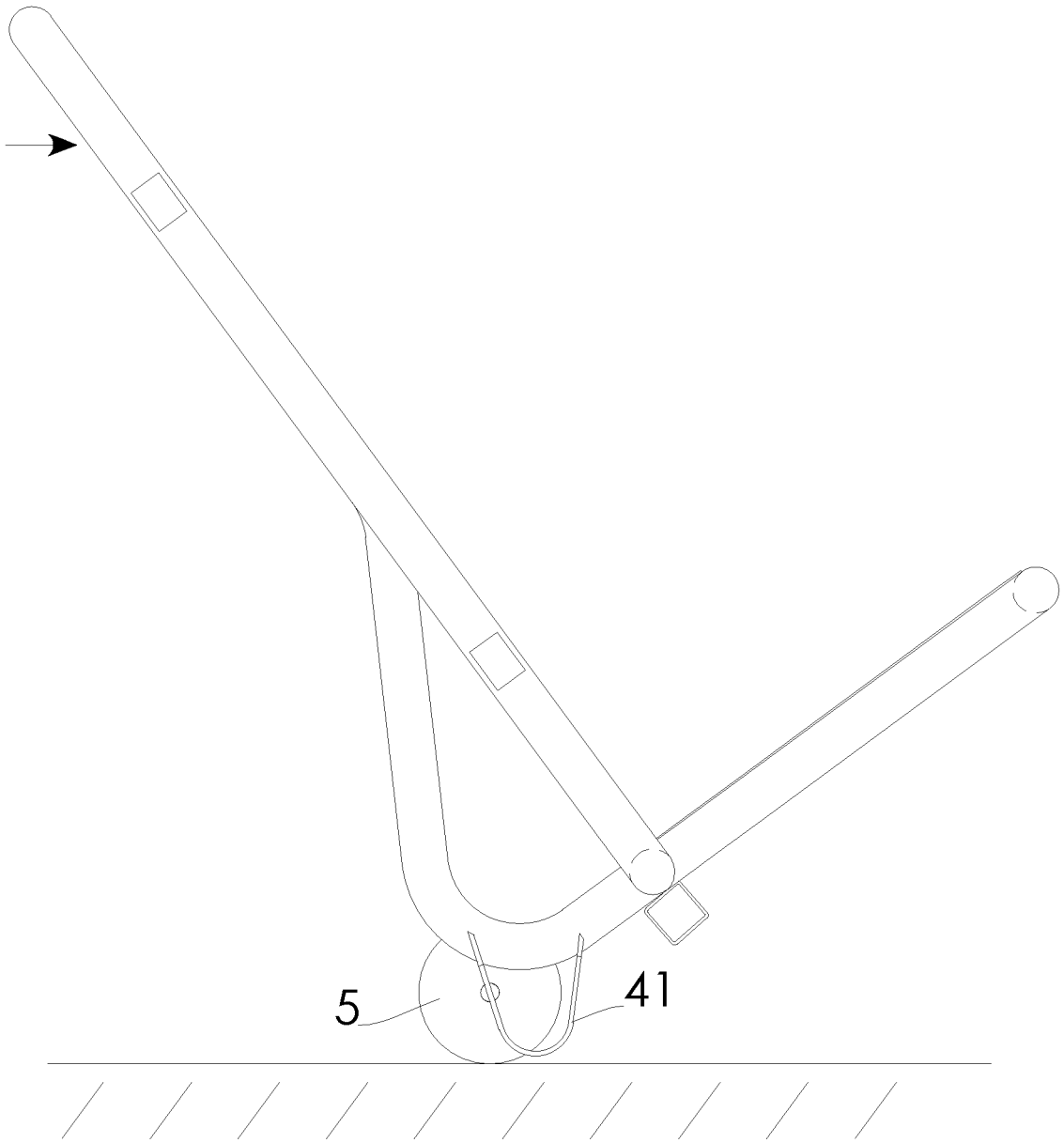

FIG. 3 shows a barrier in a displacement position, inclined with respect to the operating position, and specifically a rounded foot (41), raised off the ground, and a wheel (5) which touches the ground in this position.

Figure 4:
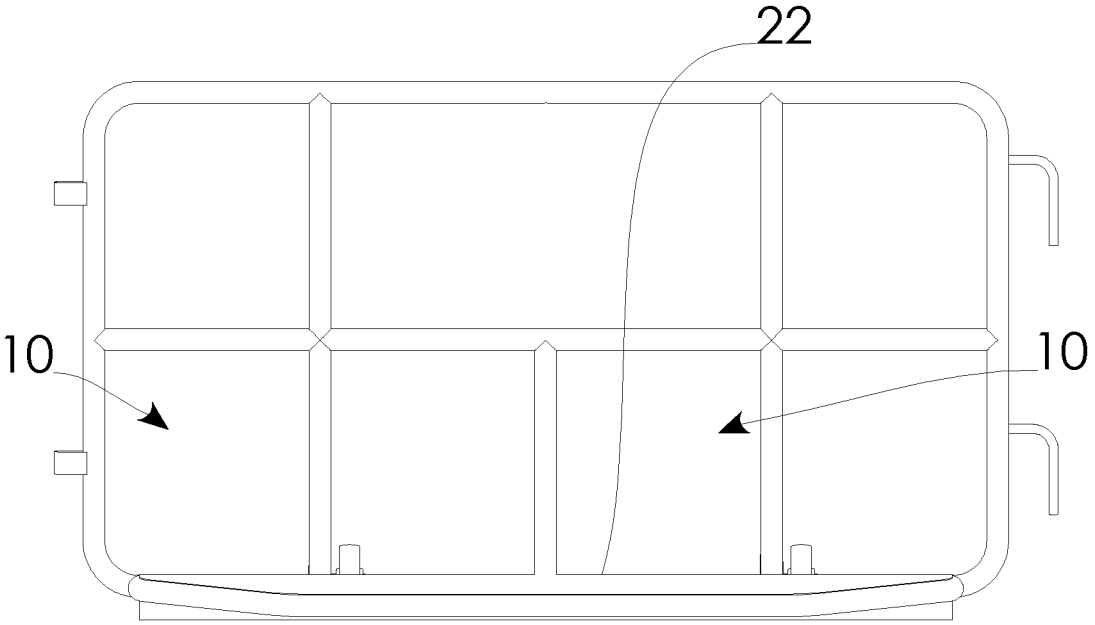

FIG. 4 shows a view of a barrier on the footboard side; the extrados of the tubular element forming the inner edge (22) of the inclined footboard (2) is clearly shown.

Figure 5:
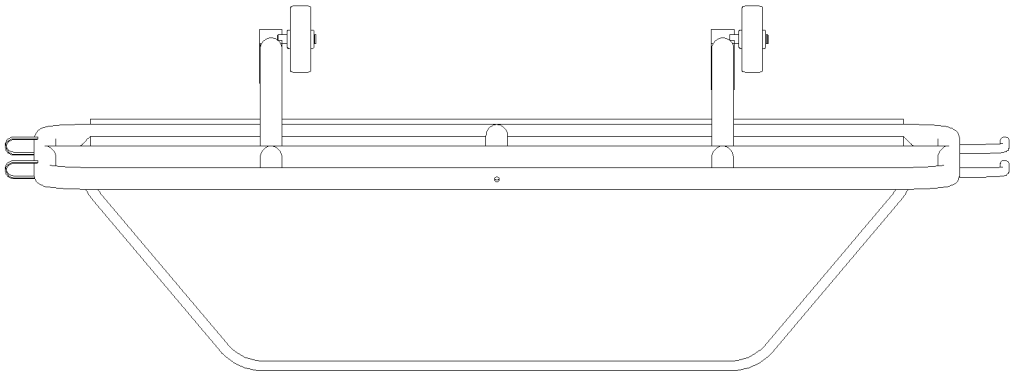
Figure 6:
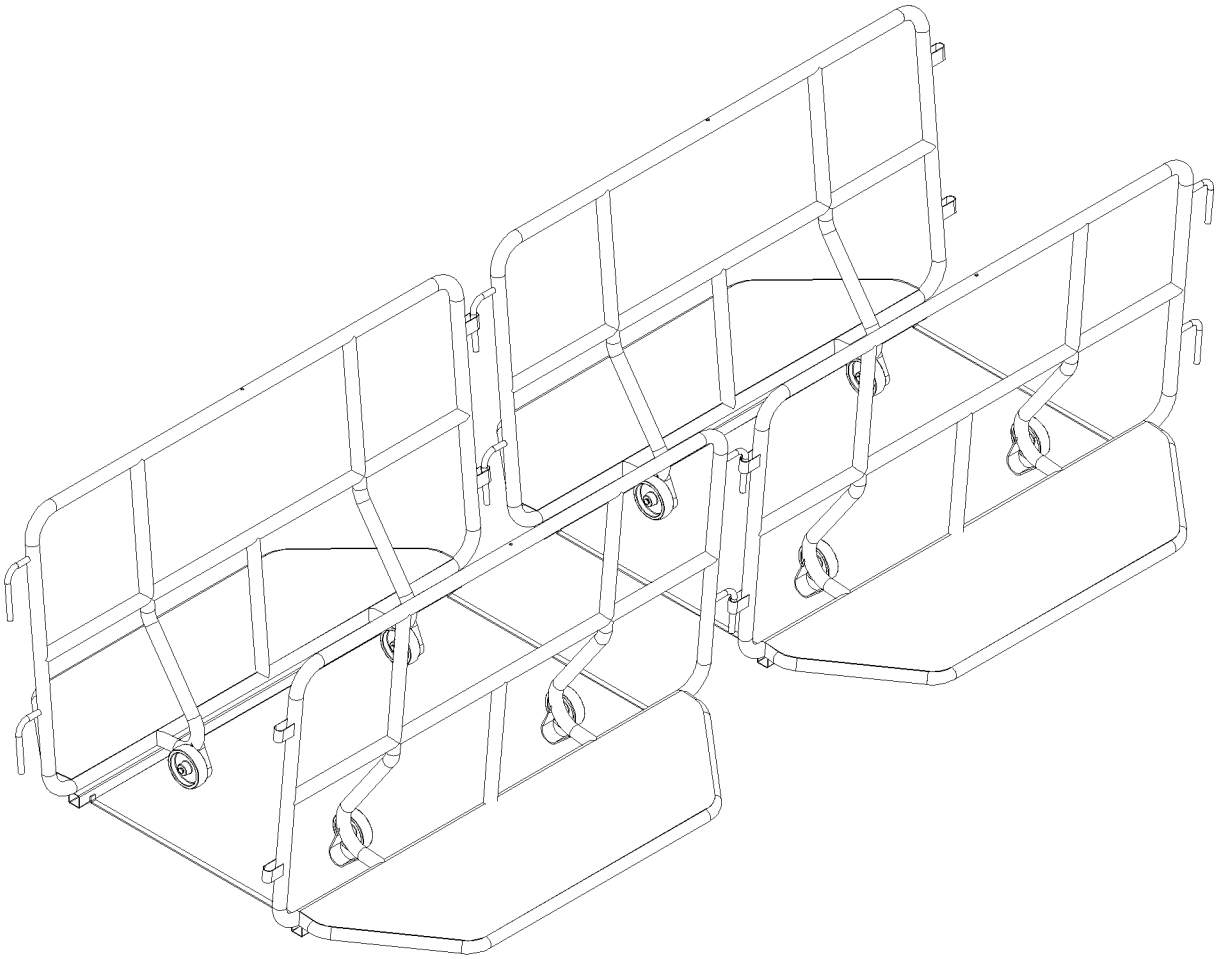
Figure 7:
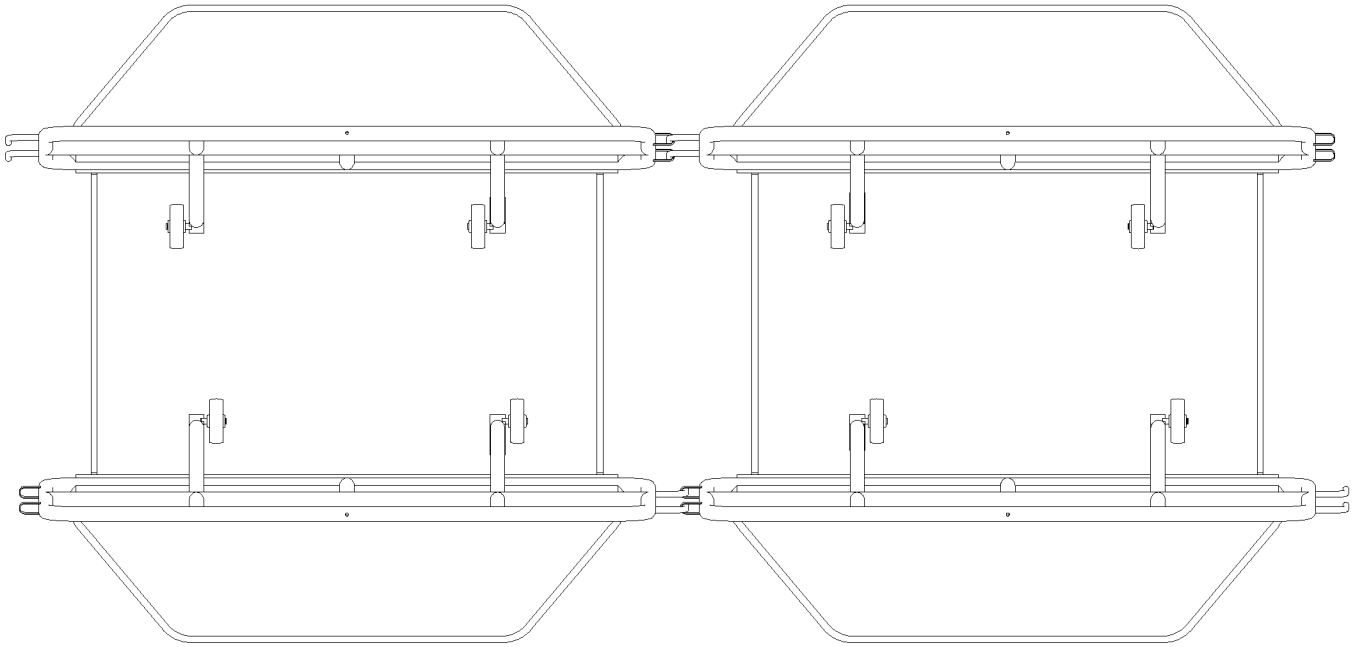
Figure 8:
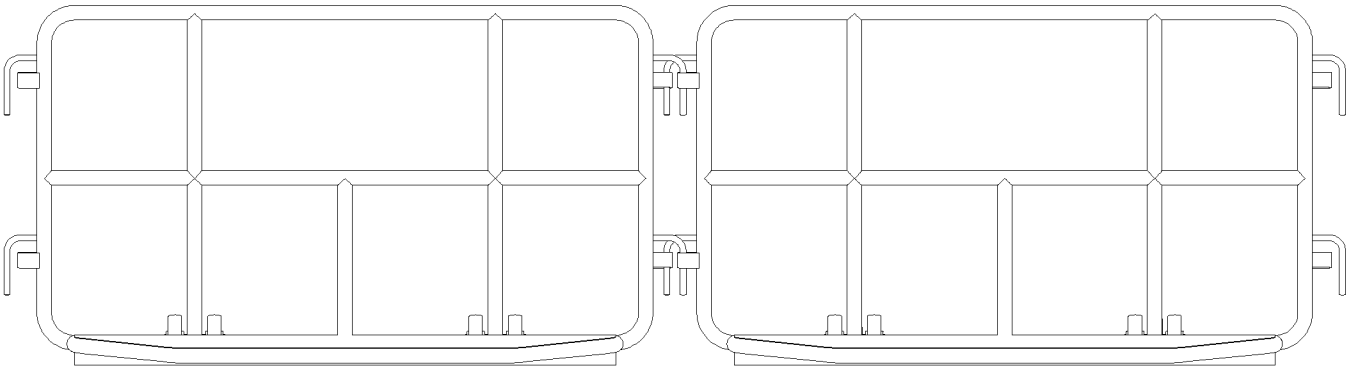
Figure 9:
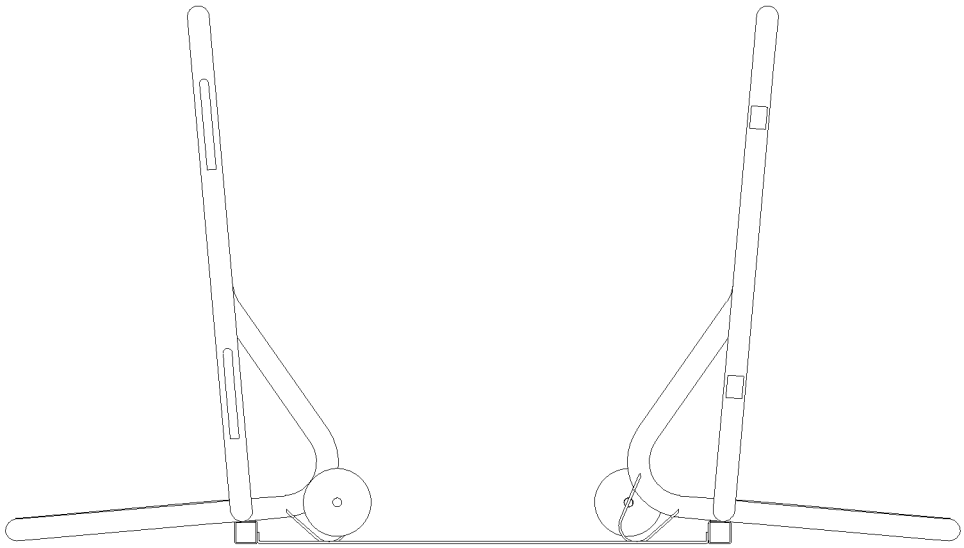
Figure 10:
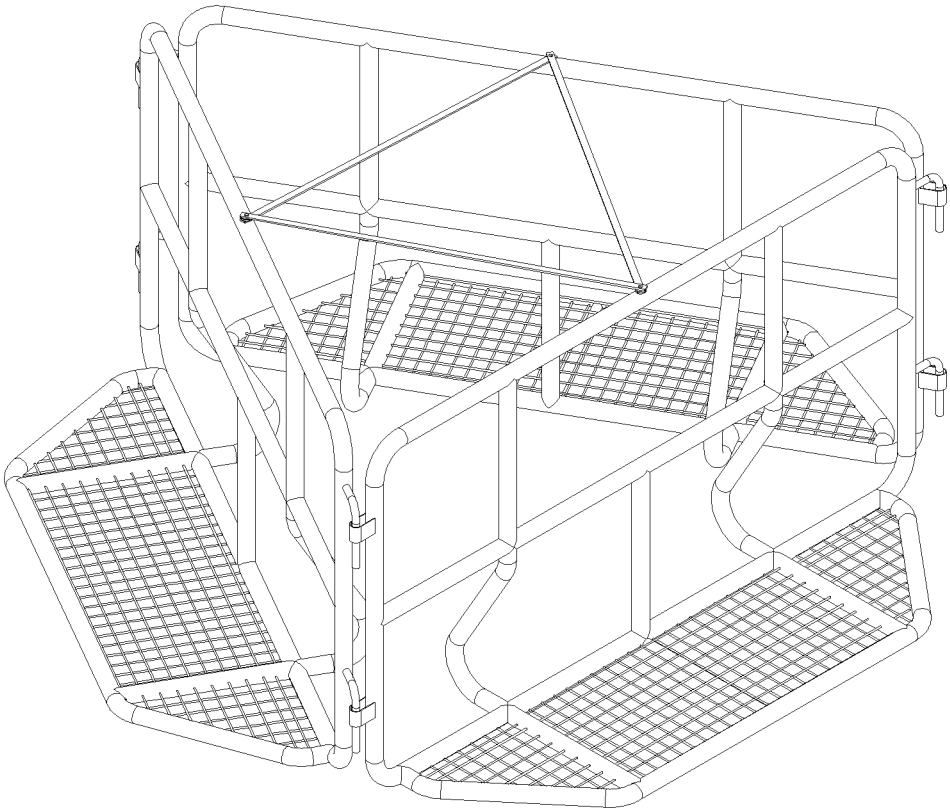
Figure 11:
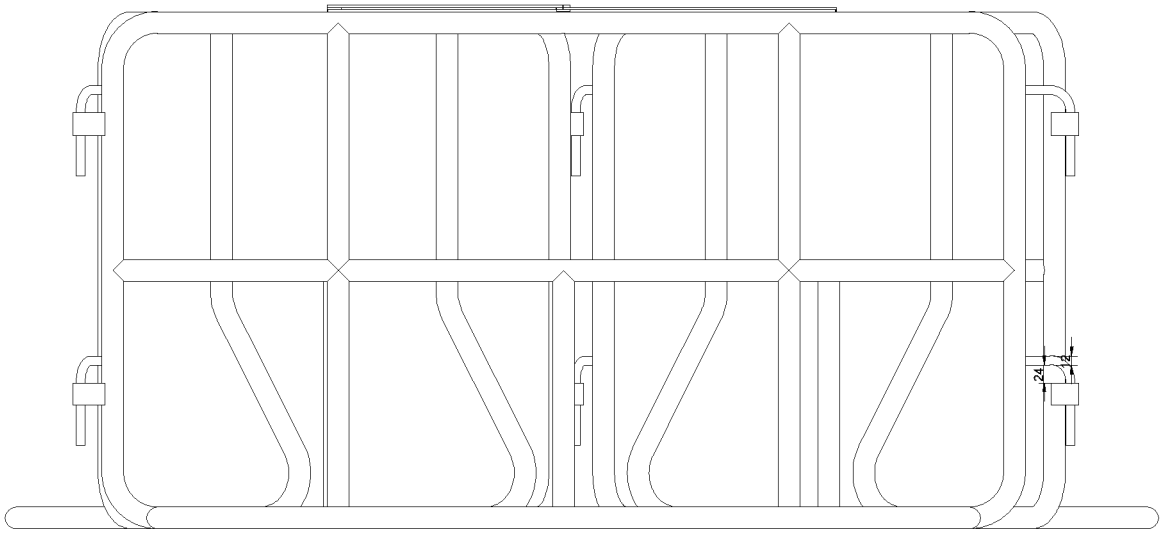
Figure 12:
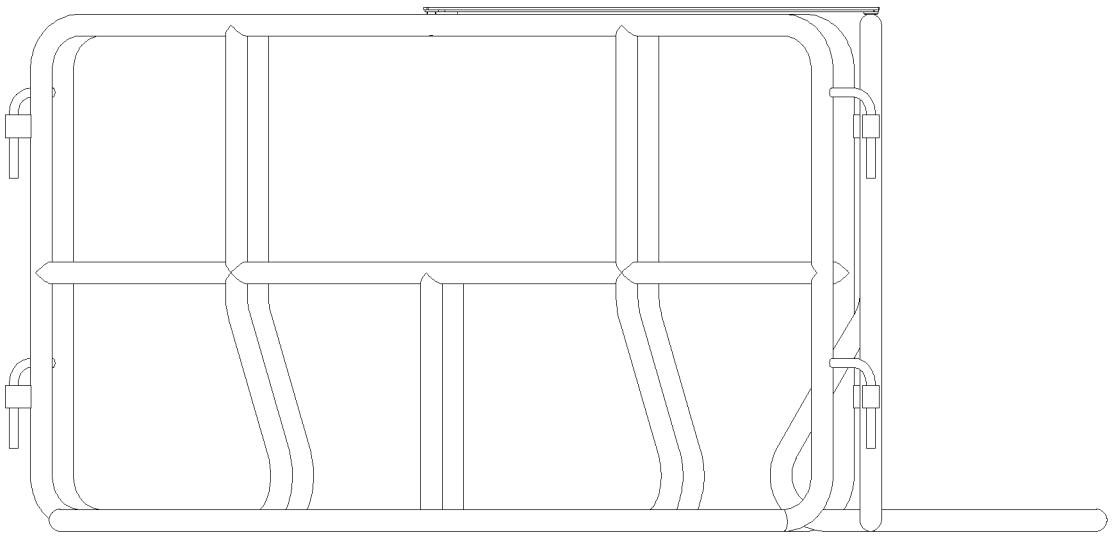
Figure 13:
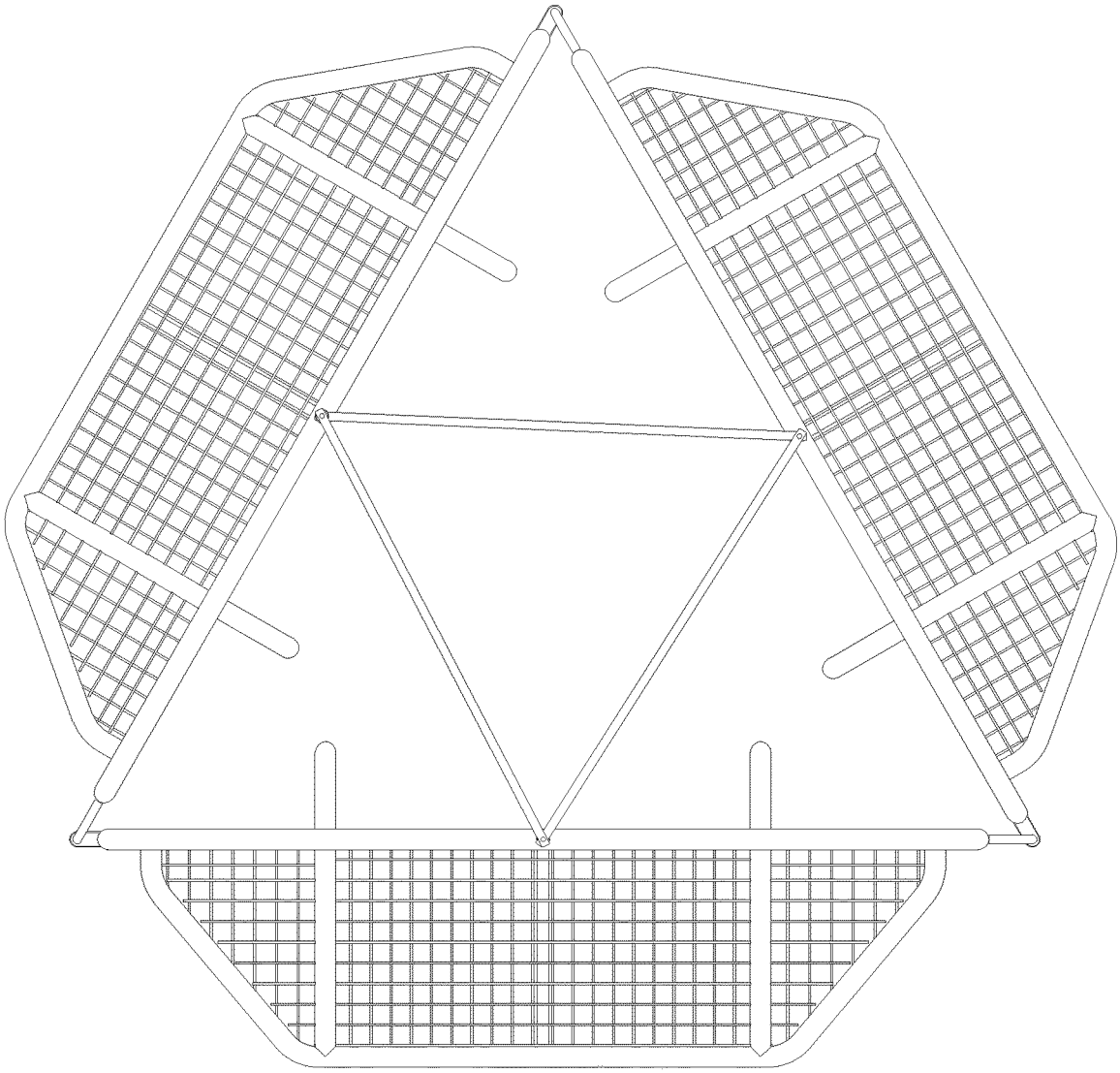

FIG. 5 shows a top view of a barrier.

FIGS. 6, 7, 8, 9, 10, 11, 12 and 13 show different options for combining the modular barrier according to the present patent application.

Figure 14:
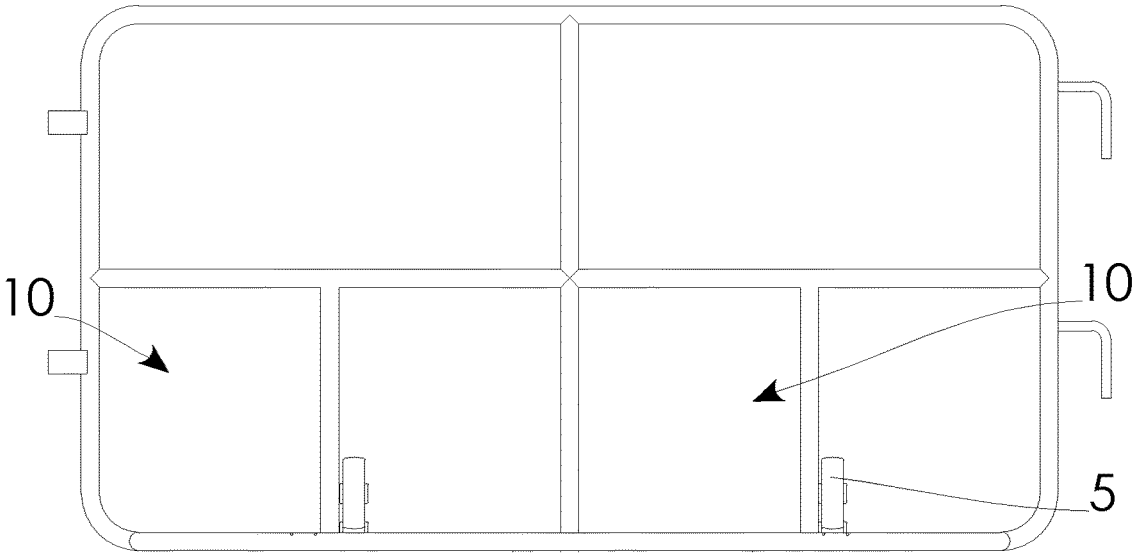
Figure 15:
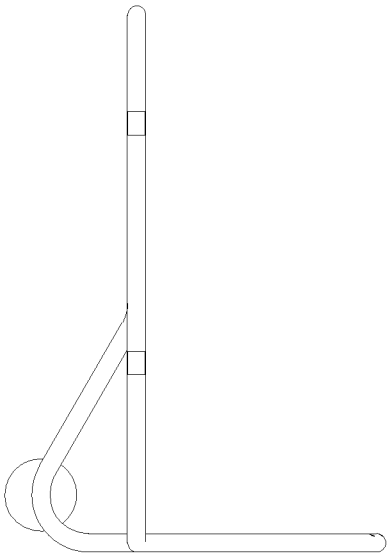
Figure 16:
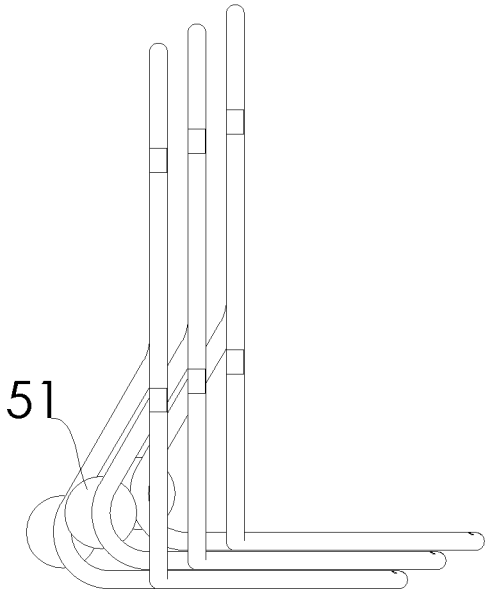
Figure 17:
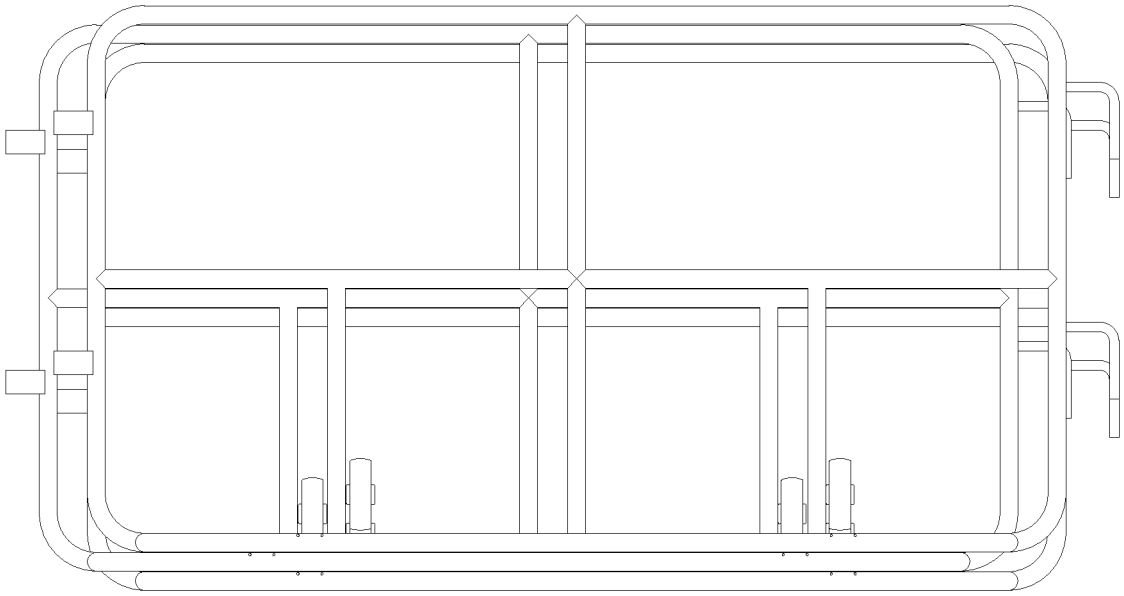
Figure 18:
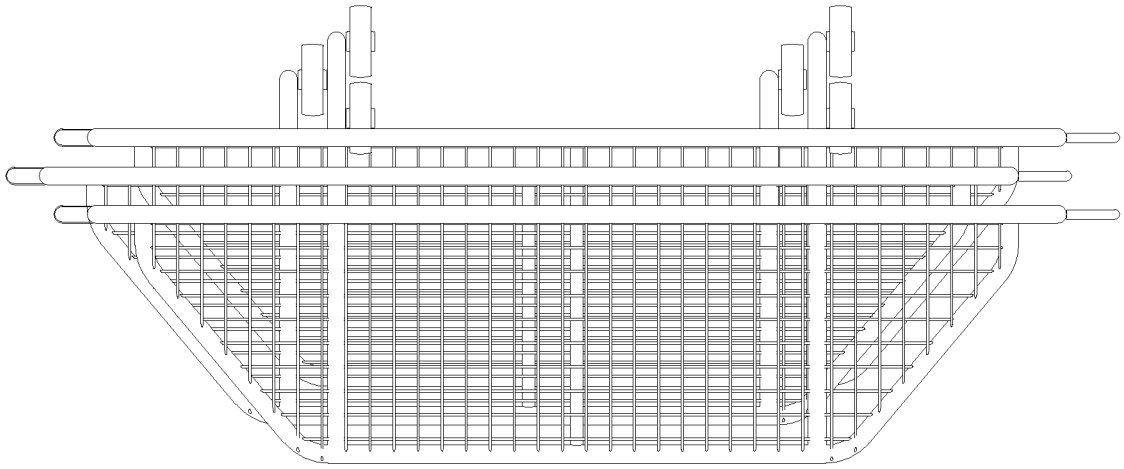
Figure 19:
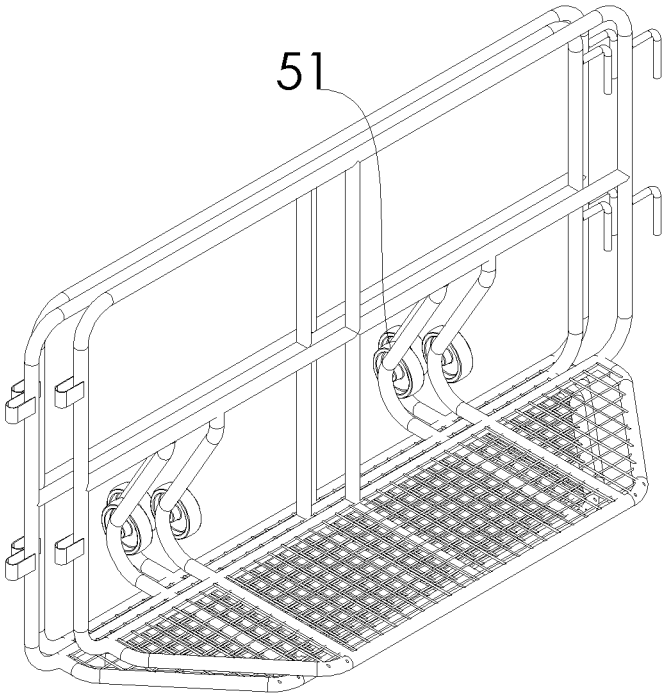

FIGS. 14 and 15 show respectively a front view and a side view of an embodiment of the barrier according to the present patent application, wherein the footboard (2) is parallel to the ground in an operating position.

FIGS. 16, 17, 18 and 19 show some views of three barriers stacked on each other, wherein the lower portion of the parapet of a first barrier defines two openings (10), each of which is suitable for receiving a wheel (51) of a second barrier.

DETAILED DESCRIPTION OF AN EMBODIMENT OF THE INVENTION

The panic modular barrier according to the present patent application comprises a footboard (2) and a parapet (1); according to a preferred embodiment, the footboard (2) is inclined and the parapet (1) is also slightly inclined on the footboard (2) side, so that it is not exactly vertical. In the latter embodiment, the outer edge (21) of the footboard (2) is in contact with the ground, whereas the inner edge (22) is slightly raised off the ground and rests thereon by way of a horizontal rectilinear bar (3). The parapet (1) raises off on the inner edge (22) of the footboard (2).

In the embodiment here described, the horizontal bar (3) consists of a tubular element featuring a square cross section, whereas the remaining main parts of the barrier, such as the footboard and the parapet, are formed of properly shaped and bent metal pipes.

The footboard (2) comprises a frame formed of a metal pipe which a decking is integrally connected to, formed of a sheet-like element, usually a sheet metal with a non-slip embossing, or a metal net with sufficiently thick and sturdy meshes as to make it rigid.

The parapet (1) is formed of a metal tubular frame, having a substantially rectangular shape and wherein the top horizontal edge makes-up the upper cross member (11); the inner edge (22) of the footboard (2) also makes-up the lower horizontal edge of the parapet (1). The frame of the parapet (1) is horizontally crossed by an intermediate cross member (12) and vertically crossed by two central uprights (14, 15); the side edges of the parapet make-up the two side uprights (13, 16). In a particularly complete version, the intermediate cross member (12) is connected to the lower horizontal edge of the parapet by a vertical half-upright (17).

The lower portion of each of the intermediate uprights (14, 15) of the parapet (1) forms a bend which projects outwards, its concavity being on the side opposite to that of the footboard (2): the two bends comprise each a rounded foot (41) and are configured, as a whole, in such a way as to form two fulcrum elements (4) which project down to touching the ground in an operating position.

Furthermore the lower portion of the parapet defines at least one opening.

In the embodiment illustrated in the figures, a wheel (5) is rotationally connected to each of the two rounded feet (41) respectively; the wheel does not touch the ground whenever the barrier is in position, whereas it touches the ground only after the barrier is slightly inclined on the side opposite to the footboard (2) one. Thanks to this arrangement, the operators in charge of positioning the barriers can easily displace them, by making them slide on the wheels, without scraping them against the ground and without being obliged to lift them.

In a particularly rich embodiment, the barrier is complemented by connection means for connecting to other identical barriers, in order to form a modular barrier; in order to perform this function, male connection means (18) and female connection means (19) are integrally connected to the two side uprights (13, 16) of said parapet (1). The same connecting function might also be performed without using connection means of a fixed type, but using appropriate joints of a known type, which allow to reversibly connect the side edges of the parapets of two barriers aligned to form a fence.

The invention claimed is:

1. A panic modular barrier comprising:

a footboard having an outer edge and an inner edge, wherein the outer edge is in contact with a ground, wherein a parapet raises off the inner edge, wherein the parapet comprises a lower portion;

at least one fulcrum element which is integrally connected to the lower portion of the parapet, wherein further the fulcrum element projects from said parapet that is proximal to the inner edge of said footboard; and at least one wheel, the at least one wheel comprising an axis of rotation, wherein the axis of rotation is parallel to the inner edge of said footboard, wherein further the wheel is rotationally connected to said at least one fulcrum element, wherein the panic modular barrier rotates around the axis of rotation between a first operating position and a second position where the panic modular barrier is tilted with respect to the ground on the side of the panic modular barrier opposite to said footboard, wherein further said at least one wheel remains in a position raised off the ground whenever the panic modular barrier is in the first operating position, wherein further a second panic modular barrier stacks with a first modular barrier when the first modular barrier is in the first operating position, wherein further said lower portion of said parapet defines at least one opening suitable for receiving a wheel of the second panic modular barrier that is stacked above the first panic modular barrier, wherein upon stacking the wheel of the second panic modular barriers does not interfere with the wheel of the first panic modular barrier, wherein said footboard is inclined and its inner edge is raised off the ground when the panic modular barrier is in the first operating position, wherein said parapet is inclined with respect to the ground on the side of said footboard.

2. The barrier according to claim 1 wherein said at least one wheel touches the ground whenever the panic modular barrier is in the second position.

3. The barrier according to claim 1 further comprising a cross bar having a cross-bar lower portion, wherein the cross-bar lower portion is in contact with the ground when the panic modular barrier is in the first operating position, which cross-bar lower portion is integrally connected to a lower portion of said inner edge of said footboard.

4. The barrier according to claim 3 wherein said cross bar is rectilinear.

5. The barrier according to claim 3 wherein the fulcrum element comprises a rounded foot, wherein the rounded foot is in contact with the ground when the panic modular barrier is in the first operating position.

6. The barrier according to claim 3 additionally comprising means for connecting a plurality of panic modular barriers.

7. The barrier according to claim 1 wherein the fulcrum element comprises a rounded foot, wherein the rounded foot is in contact with the ground when the panic modular barrier is in the first operating position.

8. The barrier according to claim 1 additionally comprising means for connecting a plurality of panic modular barriers.

9. A modular fence comprising a plurality of panic modular barriers according to claim 1, each of which additionally comprises means for connecting a plurality of panic modular barriers.

10. A modular fence according to claim 9 wherein each of the plurality of modular panic barriers additionally comprises a cross bar having a cross-bar lower portion, wherein the cross-bar lower portion is in contact with the ground when the panic modular barrier is in the first operating position, which cross-bar lower portion is integrally connected to a lower portion of said inner edge of said footboard.

11. A method of stacking a plurality of panic modular barriers, comprising:

placing a first of a plurality of panic modular barriers as set forth in claim 1 in the first operating position;

positioning a second of the plurality of panic modular barriers on top of a first of the plurality of panic modular barriers such that a wheel of the second panic modular barrier is received in an at least one opening in a parapet of the first of the plurality of panic modular barriers wherein the wheel of the second of the plurality of panic modular barriers does not interfere with the wheel of the first of the plurality of panic modular barriers;

thereafter positioning a third of the plurality of panic modular barriers on top of the second of the plurality of panic modular barriers such that a wheel of the third panic modular barrier is received in an at least one opening in a parapet of the second of the plurality of panic modular barriers wherein the wheel of the third of the plurality of panic modular barriers does not interfere with the wheels of the first and the second of the plurality of panic modular barriers;

thereafter positioning subsequent additional of the plurality of panic modular barriers whereby a wheel of each subsequent of the plurality of panic modular barriers is received in an at least one opening in a parapet of the panic modular barriers upon which each subsequent panic modular barrier is placed wherein the wheels of the stacked plurality of panic modular barriers do not interfere with the wheels of any of the other stacked plurality of panic modular barriers.

* * * * *